US006684924B1

(12) United States Patent
Kelders et al.

(10) Patent No.: US 6,684,924 B1
(45) Date of Patent: Feb. 3, 2004

(54) TAPE DISPENSER

(75) Inventors: Johannes H. J. M. Kelders, Drunen (NL); Brian A. Vulpitta, Avon Lake, OH (US); Timothy S. Ferguson, Lakewood, OH (US)

(73) Assignee: Henkel Kommenditygesellschaft auf Aktien (Henkel KGeA) (DE)

( * ) Notice: Subject to any disclaimer, the term of this patent is extended or adjusted under 35 U.S.C. 154(b) by 0 days.

(21) Appl. No.: 09/674,656

(22) PCT Filed: Jun. 2, 2000

(86) PCT No.: PCT/IB00/00741

§ 371 (c)(1),
(2), (4) Date: Mar. 20, 2001

(87) PCT Pub. No.: WO00/75060

PCT Pub. Date: Dec. 14, 2000

Related U.S. Application Data

(60) Provisional application No. 60/148,816, filed on Aug. 13, 1999.

(30) Foreign Application Priority Data

Jun. 2, 1999 (CH) ..... 1037/99

(51) Int. Cl.[7] ..... B65H 35/07
(52) U.S. Cl. ..... 156/523; 156/527; 156/577
(58) Field of Search ..... D19/69, 67, 72, D19/99, 100; 156/510, 523, 526, 527, 577; 225/6, 7, 19, 25, 45, 65, 66, 77, 89

(56) References Cited

U.S. PATENT DOCUMENTS

| | | | | |
|---|---|---|---|---|
| 2,016,527 A | | 10/1935 | Voigt | 206/52 |
| 2,324,204 A | | 7/1943 | Fischer | 216/33 |
| 2,683,547 A | | 7/1954 | Fischer | 216/33 |
| 2,722,331 A | | 11/1955 | Vogt | 216/33 |
| 3,156,603 A | | 11/1964 | Robinson | |
| 3,895,059 A | | 7/1975 | Link | |
| 4,400,231 A | | 8/1983 | Martin | 156/527 |
| 4,458,570 A | * | 7/1984 | Morrison | 220/524 |
| 5,366,129 A | * | 11/1994 | Nakamura et al. | 225/42 |
| D365,852 S | | 1/1996 | Parsey et al. | D19/69 |
| D438,567 S | | 3/2001 | Van Den Berg | |

FOREIGN PATENT DOCUMENTS

| | | |
|---|---|---|
| CH | 406 897 | 2/1964 |
| EP | 0727378 | 8/1996 |
| EP | 0779875 | 10/1999 |
| GB | 1447904 | 9/1976 |
| WO | WO 96 06790 | 3/1996 |

* cited by examiner

*Primary Examiner*—Richard Crispino
*Assistant Examiner*—Sing Po Chan

(57) ABSTRACT

A new tape dispenser (4) is proposed, with a two-piece longitudinally split segmented housing (3), a holder for a roll of tape, a discharge opening (8), a guide applicator (10) fitted to the housing (3) in close vicinity to the discharge opening (8), by means of which the tape can be applied onto a substrate, and a blade (15) with a cutting edge situated downstream of the guide applicator (10). The housing (3) has an elongated anatomical form which can be kept in the enclosing hand and at least a shallow upper depression (34) in the housing is provided close to and adjacent to the guide applicator (10) in order to exert a pressure onto the guide applicator (10) by the index finger.

19 Claims, 3 Drawing Sheets

TAPE DISPENSER

This application claims the benefit of provisional application 60/148,816 filed Aug. 13, 1999.

FIELD OF THE INVENTION

The invention pertains to a tape dispenser useful for applying adhesive tape and the like to a substrate, wherein only a single hand is required to both apply and cut the tape to a desired length.

BACKGROUND OF THE INVENTION

Adhesive tape dispensers are available in various models. In general, they are most widely known in the form of desk dispensers and hand-held dispensers requiring the use of two hands, whereby the tape roll is stored on a revolving spindle and can be cut at the desired length by means of a blade. There are also adhesive tape dispensers which can apply tape directly onto the paper, and which allow the tape to be cut using more or less elaborate cutting implements. Obviously, such adhesive tape dispensers are made up of a considerable number of components, and therefore are relatively large. Furthermore, changing rolls is often a complicated task.

SUMMARY OF THE INVENTION

The object of the invention described herein is to provide a tape dispenser which is compact in size, has few components, and can be simply and comfortably operated with one hand. The tape dispenser comprises a two-piece horizontally segmented housing, a holder for a roll of tape, a discharge opening and a blade, wherein the housing is horizontal in form, a guide applicator is fitted close to the discharge opening, by means of which the tape can be applied onto a substrate, and the blade is situated in close proximity to the guide applicator. The tape dispenser of the present invention has the great advantage of applying the tape with the guide applicator directly onto the paper and cutting the tape with a simple rotary movement against the direction of application. That is, the tape is applied to the substrate surface while holding the tape dispenser at an angle which does not bring the tape into contact with the cutting edge of the blade. When the desired length of tape has been applied, the tape dispenser angle is increased by the user so as to press the tape against the blade thereby cutting the tape. It is however also possible to hold the tape dispenser in the hand and, using the blade, cut off a strip of the desired length. Further advantageous aspects of the invention are explained in the following description in which the invention is illustrated in greater detail.

BRIEF DESCRIPTION OF THE DRAWINGS

In these diagrams, the same reference signs are always used to denote the same parts, and any explanation given once is valid for all diagrams, unless otherwise mentioned.

DETAILED DESCRIPTION OF THE INVENTION

Figure 1A:
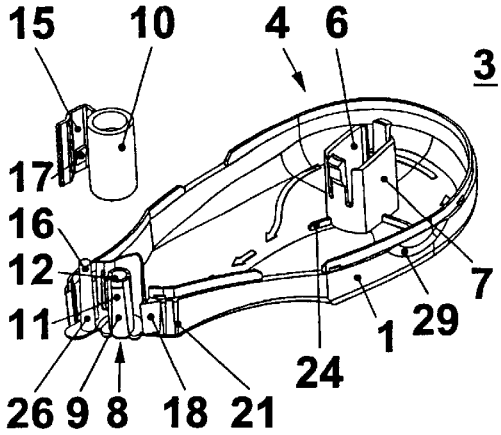
FIG. 1 a diagram in perspective of the housing component and cover forming the housing of the tape dispenser, from inside, FIG. 2 each of the two components of the housing viewed from above, FIG. 3 a diagram in perspective of each of the two components of the housing, from the outside, FIG. 4 a perspective view on a second embodiment of the housing component, FIG. 5 a perspective view on the assembled second embodiment of the tape dispenser, and FIG. 6 a cross section in longitudinal direction through the assembled second embodiment.
Figure 1B:
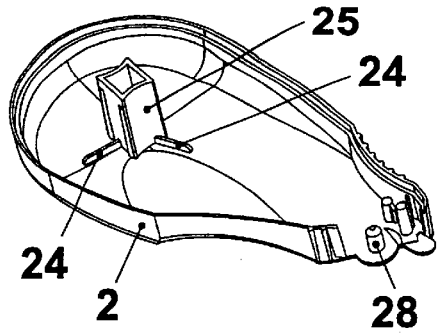

FIGS. 1*a* and 1*b* show the housing component 1 and cover 2 of a horizontally segmented housing 3 of an adhesive tape dispenser 4. The housing component may be constructed of any suitable material such as a thermoplastic. If the housing component is transparent or translucent, the user may readily determine how much tape remains in the dispenser without removing the cover. A dye or pigment may be incorporated into the thermoplastic to impart a desired color to the housing component. The housing component 1 contains a housing lug 6 (preferably hollow) onto which the inner spool 7 of a roll of tape (not depicted) is fixed. The size of the opening in the inner spool 7 and the size of the housing lug 6 should be selected such that the tape roll may be rotated with minimal effort when the tape is rolled out onto a substrate. At the same time, however, there preferably should be sufficient friction between these two components to prevent the tape roll from turning freely during storage and causing the tape to unwind unintentionally from the roll and adhere to the housing interior.

The diameter of the roll of tape is slightly smaller than the internal dimensions of the housing component 1 such that it fills the space provided almost completely. In one preferred embodiment of the invention, the tape roll is configured to be compact in size, thus allowing the dispenser to be readily handled and manipulated by the user. To save space, the use of a spool having a single, relatively thin wall rather than a conventional double wall spool is preferred. The inner diameter of the opening in the inner spool 7 which fits over the housing lug 6 is preferably less than 1 inch (2.5 cm), more preferably about 0.4 inches (1.0 cm) to about 0.6 inches (1.5 cm). It will generally be desirable for the outer diameter of the inner spool to be less than 1.1 inches (2.8 cm), more preferably about 0.5 inches (1.3 cm) to about 0.7 inches (1.8 cm). The use of a relatively small diameter inner spool permits a large quantity of tape to be supplied in a compact dispenser. For example, about 400 inches (1000 cm) of adhesive tape of conventional thickness wound on an inner spool having a 0.50 inch (1.3 cm) inner diameter and 0.625 inch (1.6 cm) outer diameter will provide a tope roll having an overall diameter of only about 1.25 inches (3.2 cm). The overall diameter of the end of the housing 3 containing the tape roll thus need be no larger than about 1.50 inches (3.8 cm). Preferably, the overall diameter of the tape roll will be about 1.5 inches (3.8 cm) with a tape length of at least about 350 inches (875 cm), or less, preferably about 1.25 inches (3.2 cm) with a tape length of at least about 300 inches (750 cm).

The tape dispenser of the present invention may be readily adapted to accommodate any width of tape that may be desired simply by changing the width of the housing 3, guide applicator 10, cutting blade 15 and other appropriate components of the dispenser. If the tape dispenser is to be used with one hand, however, the width of the tape roll should generally not be greater than about 4 inches (10 cm), preferably no greater than about 3 inches (7.6 cm), so that the dispenser may still be readily grasped and manipulated with one hand. As readily can be seen from FIGS. 1*a* and 1*b* the housing 3 has an elongated anatomical form, such that it can be surrounded easily by the fingers of an almost closed hand. The dimensions of the housing are such that the length thereof with be approximately twice its width. Preferably the width of the housing 3 is to about 1.4 inches (3.8 cm) and its length is preferably to about 3.0 inches (7.5 cm).

The housing component 1 also comprises a discharge opening 8 positioned near a guide applicator 10. Further the housing 3 has in the vicinity of the tape roll holder or hollow lug 6 a cylindrical form adapted to the tape roll and in the vicinity of the discharge opening 8 a tapered form. When the tape dispenser is held against a substrate surface by the user, the guide applicator 10 presses the adhesive side of the tape against the substrate. This pressure causes the end of the tape projecting from the discharge opening to adhere to the substrate. As the user draws the tape dispenser over the substrate, the tape passes smoothly under the guide applicator and the length of tape thus dispensed is similarly caused to adhere to the substrate by the pressure exerted by the guide applicator against the substrate surface. The guide applicator may be a guide roller 10 fixed on a centered spindle lug 9. In the illustrated embodiment of the invention, the guide roller 10 is capable of rotating about the spindle lug 9. The free end of the lug 9 is formed out of resiliently formed half cylindrical clamping means 11 with bulges 12 which click in a broadened ring groove of the guide roller 10. In alternative embodiments of the invention, however the guide applicator is fixed or stationary and may, for example, be a curved or arc-shaped outwardly projecting section of the housing 3. The guide applicator may also take the form of a wiper blade; the wiper blade should be blunt or rounded to prevent premature cutting of the tape and may be flexibly or resiliently attached to the housing 3. Above the guide applicator 10, a blade 15 with a cutting edge is fixed onto a housing lug 16. Alternatively, the blade may be an integral part of the housing 3, particularly where it is formed of the same material as the housing (e.g. plastic). The blade may be constructed of any suitable material; although metal is generally preferred, plastic may also be used. In one embodiment of the invention, the cutting edge of the blade is equipped with small teeth, preferably teeth of differing lengths. For example, relatively long teeth may be alternated with relatively short teeth. The individual teeth may advantageously project at different angles from the plane of the main body of the blade. Furthermore, the one-piece blade 15 may be provided with clamps 17 which are connected together at their front and rear extremities.

Figure 2A:
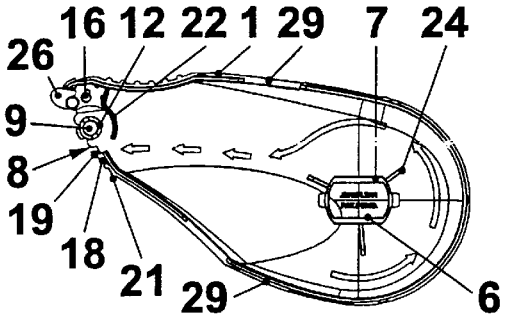

Beneath the guide applicator 10 there is formed a guide plate 18 with two small longitudinal serrations 19 as part of the housing component 1. Thus, between the guide applicator 10 and the guide plate 18 there remains a small discharge opening 8, through which the adhesive tape is fed from the housing 3 (cf. arrows in FIGS. 1*a* and 2*a*). The guide plate 18 is preventing the adhesive tape to be retracted into the housing. On the other hand the adhesive side of the tape will only stick loosely to the serrations 19. Moreover, the distance between the discharge opening 8 and the cutting blade 15 is preferably selected so as to provide, after applying a portion of tape to a substrate and cutting off said portion, a length of tape protruding form the discharge opening 8 which is sufficient to reduce the propensity of the tape end falling back or to be retracted into the housing 3. The tape end is thus kept readily available for the next use of the dispenser. At the same time, however, this distance should not be excessive, since this will increase the likelihood that the protruding tape end will become contaminated with dirt or adhered to the housing exterior or to other objects during storage or handling. Distances of from about 0.25 to about 0.75 inches (about 0.6 to about 1.9 cm) will generally be suitable, for example.

Figure 2B:
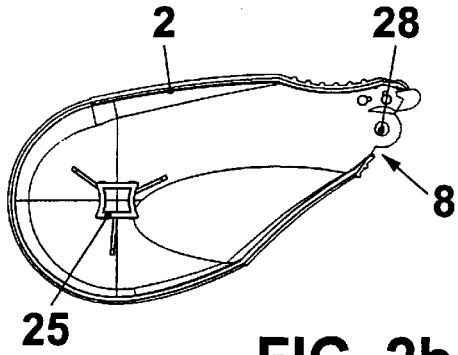

As shown in FIGS. 1*a* and 2*b*, one or more ridges 21 may be provided on the exterior surface of the cover 2 and/or the housing component 1 in the area adjacent to the discharge opening on the side of the discharge opening 8 opposite the guide roller 10. Such ridges make it easier to remove any tape which may be accidentally adhered to the exterior of the housing. A guide shield 22 may be provided which projects down from the top of the housing and surrounding the guide roller 10 and which helps to ensure proper threading of the tape through the discharge opening 8 when the tape roll is replaced. In addition, situated close to the housing lugs 6 are radial separators 24, which serve to keep the inner spool 7 and therefore the roll of tape at a small distance from the inner wall of the housing component 1. The cover 2 is also fitted with a housing lug 25 (preferably hollow) which can be inserted into the lug 6. Here too, radial separators 24 are fitted. As can be readily seen from FIGS. 1*a* and 1*b* the lug 6 and the housing lug 25 have an elongated shape especially rectangular to engage the inner spool 7 of the adhesive tape roll. The radial separators 24 on the housing component 1 and cover 2 function to keep the roll of tape approximately centered in the longitudinally split housing and reduce the amount of friction which might otherwise exist if the roll of tape were permitted to bear directly against the interior walls of the housing 3.

As can be seen from FIGS. 1*a* and 1*b*, a small guide cheek 26 is provided close to the blade 15, both in the housing component 1 and on the cover 2; this cheek holds the tape which is to be cut against the cutting edge of the blade 15 when the angle of the tape dispenser relative to the substrate to which the tape is being applied is increased, and also serve to keep the tape in position on the guide applicator 10. At smaller angles, however, the cheeks 26 hold the blade 15 away from the tape. The guide cheeks preferable are rounded, rather than sharply pointed, in shape to facilitate smooth application and cutting of the tape. Preferably, the guide cheeks 26 extend about the same distance from the surface of the housing 3 as the outmost point of the guide applicator. A distance of about 0.05 inches (0.13 cm) to about 0.15 inches (0.38 cm) has generally been found to be suitable for purposes of this invention. In a preferred embodiment, the cutting edge of the blade is slightly recessed relative to the outermost extremity of the guide cheek. Recessing the cutting edge in this manner helps to minimize damage (e.g. tearing) to the substrate to which the tape is applied when the tape is cut. It will generally be desirable to position the cutting edge of the blade near the edge of the cheek guides on the side of the cheek guides away from the guide roller 10 and in an orientation such that the cutting edge falls in a plane which is approximately parallel to said edge. The cover 2 is also fitted with a centering pin 28 close to the discharge opening 8, which can be inserted into hollow opening of the spindle lug 9 of the housing component 1. Furthermore, the cover 2 is easily detachable from the housing component 1, so that it is especially easy to change the tape. A notch 29 may be placed on the exterior of the housing 3 along an edge of the housing component 1 where it meets an edge of the cover 2 to facilitate separation of the housing component and cover using a fingernail or the like; the notch 29 may also be placed along the edge of the cover 2 where it is joined to the housing component 1. Because of the rectangular form of both lugs 6 and 25 the housing component 1 and the cover 2 can be easily assembled in a guided manner.

Figure 3A:
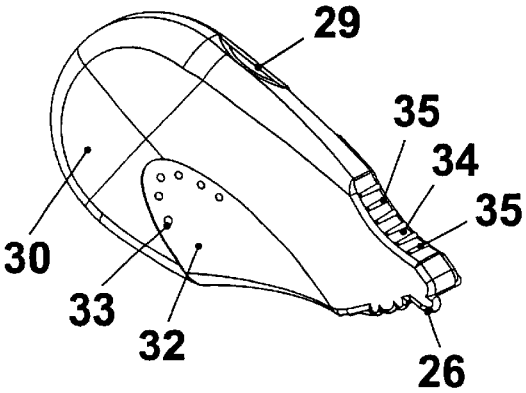
Figure 3B:
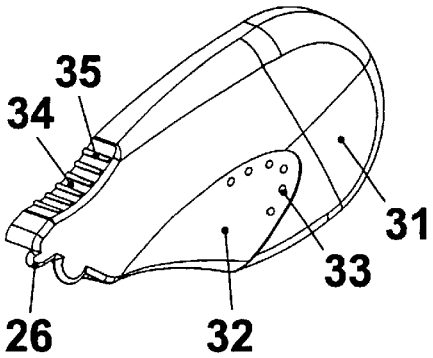

As can be seen in FIGS. 3*a* and 3*b*, the outer surface 30 of housing component 1 and the outer surface 31 of the cover 2 are provided with shallow side depressions 32 with knobs 33, close to the guide roller 10, into which a middle finger and thumb can be inserted. Above the blade 15 there is an upper depression 34 with ridges 35, into which the index finger can be inserted. Moreover, the housing 3 is gently chambered in the guide roller 10 and blade 15 areas, in order not to unnecessarily slow down the discharge of tape.

As can be seen from the diagrams, the above-illustrated adhesive tape dispenser 4 only comprises four parts, namely the housing component 1, the cover 2, the guide applicator 10, and the blade 15. In alternative embodiments, the number of parts is even further reduced where one or both of the guide applicator 10 and the blade 15 are not separate but are integral components of the housing component 1 and/or cover 2. It is a further advantage of the described tape dispenser 4 that the tape is completely enclosed within the housing, other than the short tape end protruding from the discharge opening 8. This helps avoid contamination of the unused tape, which is a problem for the conventional "open" type of tape dispenser. A special holder can be provided which surrounds at least the upper exterior of the tape dispenser 4, so that the guide applicator 10 and the cutting blade 15 are turned upwards and the user can pull out a piece of tape in the usual manner.

If so desired, the tape dispenser may be fitted during storage with a cap which encloses at least the discharge opening 8 (preferably, also the guide roller and blade) and protects the exposed end of tape which projects from said discharge opening.

Figure 4:
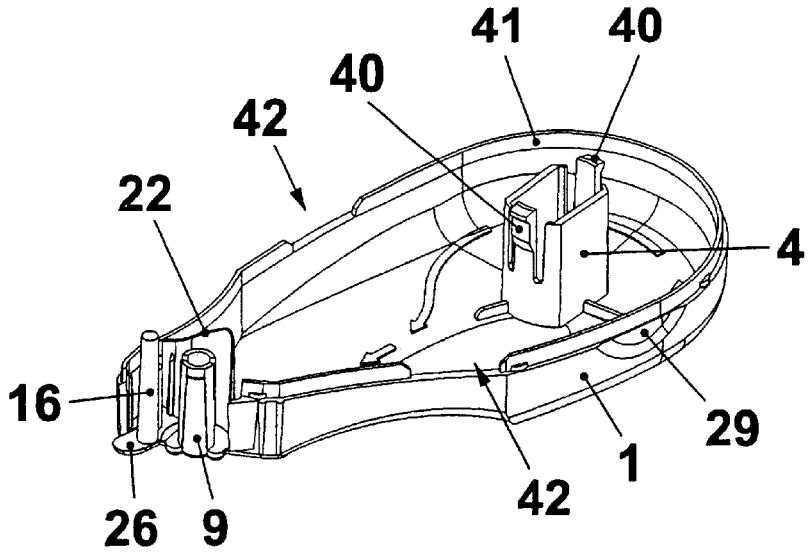
Figure 5:
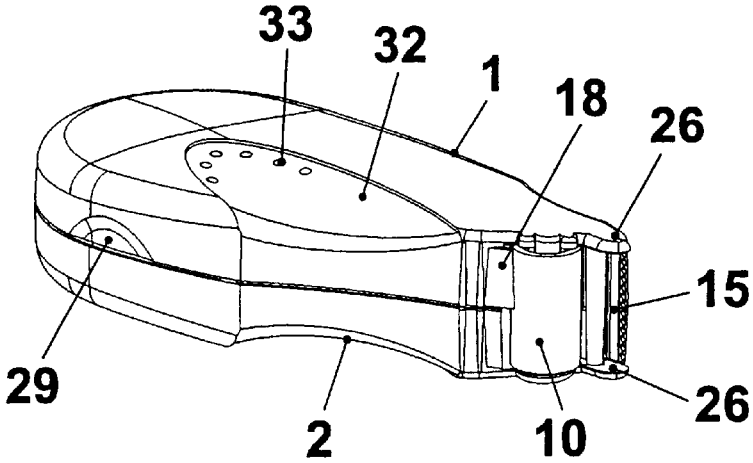
Figure 6:
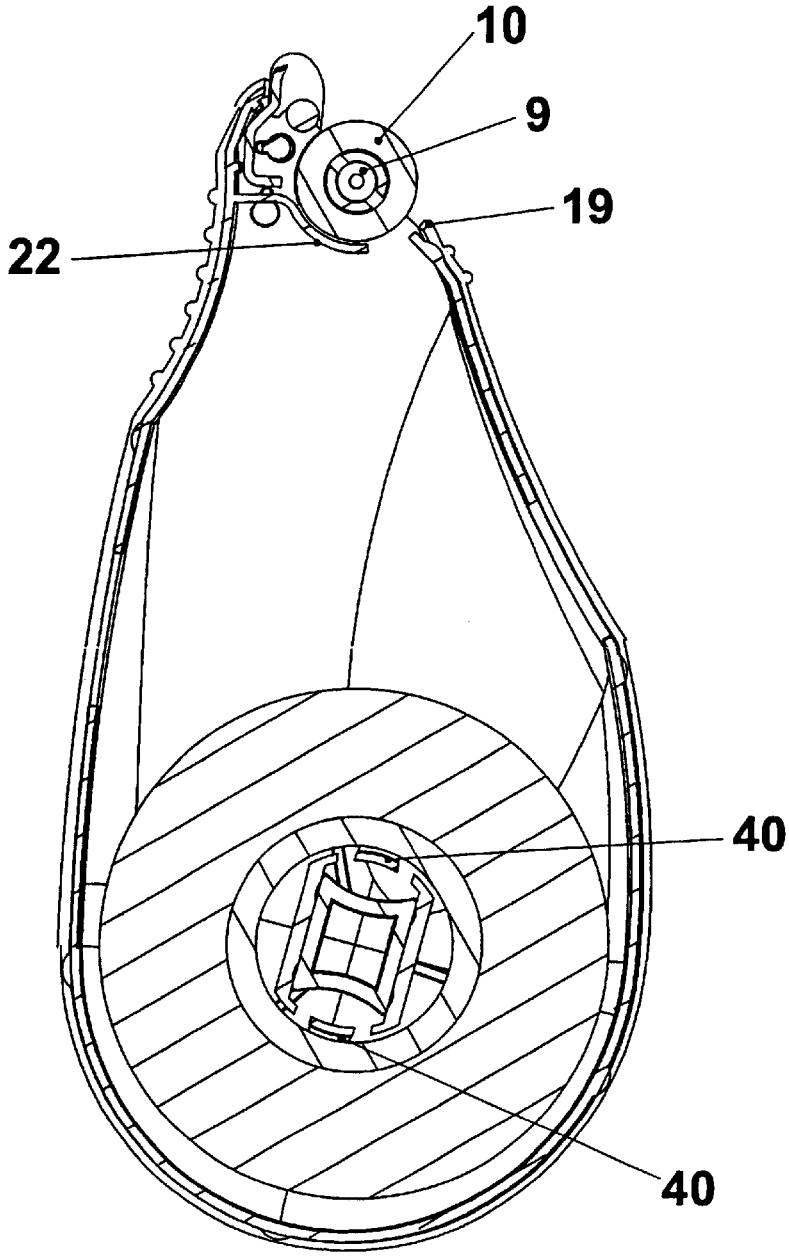

In FIGS. 4 and 5 an alternative embodiment of the tape dispenser according to the present invention is shown. As readily can be seen in FIG. 4 the lug 6 of the housing component 1 has two resiliently mounted clamps 40 which engage with the inner spool 7 of the roll of adhesive tape. These outwardly pressing clamps 40 will urge a constant friction to the inner spool 7 and will keep the adhesive tape roll fixed when the cover will be separated, which is more or less identical with the cover 2 shown in FIG. 1*b*. The clamps 40 will prevent also that the inner spool 7 will shrink at temperatures higher as e.g. 65° C. As can be seen in the cross sectional view of FIG. 6 the guide shield 22 is surrounding the guide roller 10 more smoothly, i.e. having a cylindrical form over almost 90° and having a radius somewhat larger as the radius of the guide roller 10. In this example of the invention the cutting blade 15 has a L-formed profile ad is clamped between notches of the housing component 1. As can be seen in FIG. 4 there is provided a circumferential rim 41 for receiving the cover 2. In the rim 41 two cut-outs 42 are arranged. In order to market the above described tape dispenser a carton card (here not depicted) of greater size with a cut-out of exactly the circumference of the tape dispenser can take it up. In fact the card will have a cut-out somewhat narrower so that the tape dispenser will be pitched by the card.

What is claimed is:

1. A tape dispenser with a two piece longitudinally split segmented housing having two housing parts, a holder for a roll of tape, a discharge opening, a guide applicator fitted to the housing in close vicinity to the discharge opening whereby the tape can be applied onto a substrate, and a blade with a cutting edge situated downstream of the guide applicator, characterized in that the housing has a guide cheek disposed adjacent to and along each side the blade, the guide cheeks being rounded in shape, the blade being recessed from the outermost extremity of the guide cheeks, the cutting edge of the blade being equipped with a plurality of teeth, the guide applicator being a rotatable roller, the discharge opening being located near the guide applicator, the distance between the discharge opening and the cutting blade being in the range of about 0.25 to about 0.75 inches, the two housing parts being detachably mounted together, the housing being of elongated form whereby the housing can be surrounded by the fingers of an almost closed hand, one end of the housing being of semi-circular shape where the tape is located and the housing tapering in shape at its opposite end whore the guide roller and blade are located, the housing having a length approximately twice as long as its width, the housing having a length of about 3 inches, the holder for the roll of tape including a hollow lug mounted to each housing part, the lugs being of non-circular complementary shape, one of the lugs being telescoped into the other lug to form a telescoped lug assembly, the roll of tape being mounted around the lug assembly, each of the guide cheeks being mounted to a different one of the housing parts, and aligned ridges on each of the housing parts extending across the assembled housing hoar the blade for accommodating a user's finger during dispensing of the tape.

2. Tape dispenser according to claim 1, characterized in that at least one of the housing parts is transparent.

3. Tape dispenser according to claim 1, characterized in that at least one of the housing parts is a colored plastic.

4. A tape dispenser with a two-piece longitudinally split segmented housing having two housing parts, a holder for a roll of tape, a discharge opening, a guide applicator fitted to the housing in close vicinity to the discharge opening whereby the tape can be applied onto a substrate, and a blade with a cutting edge situated downstream of the guide applicator, characterized in that the housing has an elongated form which can be kept in the enclosing hand, the holder for the roll of tape including a hollow lug mounted to each housing part, the lugs being of non-circular complementary shape, one of the lugs being telescoped into the other lug to form a telescoped lug assembly, and the roll of tape being mounted around the lug assembly, characterized in that each housing part has an inner surface, and a plurality of separators on the inner surface near the lugs spacing the tape from the inner surfaces of the housing parts, characterized in that the separators are of thin elongated form extending radially around each lug.

5. Tape dispenser according to claim 4, characterized in that two guide cheeks are positioned opposite each other in the housing next to the blade.

6. Tape dispenser according to claim 5, characterized in that the blade is recessed slightly from the outermost extremity of the guide cheeks.

7. Tape dispenser according to claim 4, characterized in that the housing is designed with at least a shallow side depression close to the guide applicator which serves to allow easy handling of the housing using the thumb and the middle finger.

8. Tape dispenser according to claim 4, characterized in that the housing has a semi-circular cylindrical shape in the tape roll area and a sharply tapering shape in the guide roller and blade area, at least a shallow upper depression in the housing being provided close to and adjacent to the guide applicator in order to exert a pressure onto the guide applicator by the index finger, and the housing further has a gently cambered shape in the guide applicator and blade areas.

9. Tape dispenser according to claim 4, characterized in that a notch is present in the outer surface of the edge of one piece of the housing which is adjacent to an edge of the second piece of the housing.

10. Tape dispenser according to claim 4, characterized in that the roll of tape has an overall diameter of 1.5 inches or less and contains at least about 300 inches of tape.

11. Tape dispenser according to claim 4, characterized in that the roll of tape has an overall diameter of about 1.25 inches or less and contains at least about 350 inches of tape.

12. Tape dispenser according to claim 4, characterized in that the guide applicator projects out beyond the discharge opening and a small opening remains between the guide applicator and the housing to allow the tape to be fed through, and the distance between the discharge opening and the cutting blade ranging from about 0.25 to about 0.75 inches.

13. Tape dispenser according to claim 4, characterized in that the blade is one piece and comprises at least two clamps on the end of the blade facing away from the cutting edge of the blade which can be fitted onto a housing lug.

14. Tape dispenser according to claim 13, characterized in that the clamps are connected to each other at their front and rear ends, and the blade is made of metal.

15. Tape dispenser according to claim 4, characterized in that the guide applicator is a rotatable roller and is fitted onto a rotary lug in the housing.

16. Tape dispenser according to claim 4, characterized in that the blade has a cutting edge equipped with a plurality of teeth, the teeth comprising both short teeth and long teeth, and the short teeth being alternated with the long teeth along the cutting edge.

17. Tape dispenser according to claim 4, characterized in that the roll of tape comprises tape wound around an inner spool, and one of the lugs having resilient clamps engaging the inner spool.

18. Tape dispenser according to claim 17 characterized in that the resilient clamps are spring fingers terminating in outwardly extending flanges.

19. Tape dispenser according to claim 4 characterized in that the roll of tape is tape wound on an inner spool, and the diameter of the inner spool being no greater than 0.7 inches.

* * * * *

UNITED STATES PATENT AND TRADEMARK OFFICE

CERTIFICATE OF CORRECTION

PATENT NO. : 6,684,924 B1
DATED : February 3, 2004
INVENTOR(S) : Kelders et al.

It is certified that error appears in the above-identified patent and that said Letters Patent is hereby corrected as shown below:

Title page,
Item [73], Assignee, delete "Henkel Kommenditygesellschaft auf Aktien (Henkel KGeA), and insert -- Henkel Kommanditgesellschaft auf Aktien (Henkel KGaA) --.
Item [56], References Cited, FOREIGN PATENT DOCUMENTS, delete the second instance of "WO".

Column 6,
Line 7, delete "whore" and insert -- where --.
Line 17, delete "hoar" and insert -- near --.

Signed and Sealed this

Twenty-first Day of March, 2006

JON W. DUDAS
*Director of the United States Patent and Trademark Office*